US009589777B2

(12) United States Patent
Papanastasiou et al.

(10) Patent No.: US 9,589,777 B2
(45) Date of Patent: Mar. 7, 2017

(54) CONTROL OF IONS

(71) Applicant: FASMATECH SCIENCE & TECHNOLOGY SA, Athens (GR)

(72) Inventors: Dimitris Papanastasiou, Athens (GR); Emmanuel Raptakis, Athens (GR); Diamantis Kounadis, Athens (GR); Alexander Lekkas, Athens (GR); Ioannis Orfanopoulos, Athens (GR); Ioannis K Nikolos, Ioannina (GR)

( * ) Notice: Subject to any disclaimer, the term of this patent is extended or adjusted under 35 U.S.C. 154(b) by 62 days.

(21) Appl. No.: 14/411,093

(22) PCT Filed: Jun. 25, 2013

(86) PCT No.: PCT/GR2013/000037

§ 371 (c)(1),
(2) Date: Dec. 23, 2014

(87) PCT Pub. No.: WO2014/001827

PCT Pub. Date: Jan. 3, 2014

(65) Prior Publication Data

US 2015/0340218 A1 Nov. 26, 2015

(30) Foreign Application Priority Data

Jun. 24, 2012 (GB) ..... 1211186.0

(51) Int. Cl.
*H01J 49/00* (2006.01)
*H01J 49/04* (2006.01)

(52) U.S. Cl.
CPC ..... *H01J 49/0404* (2013.01); *H01J 49/0495* (2013.01)

(58) Field of Classification Search
CPC ..... H01J 49/00; H01J 49/02; H01J 49/0404; H01J 49/0422; H01J 49/04
USPC ..... 250/281, 282, 288, 289
See application file for complete search history.

(56) References Cited

U.S. PATENT DOCUMENTS

2011/0183431 A1* 7/2011 Covey ..... G01N 27/624 436/173
2011/0220790 A1* 9/2011 Sun ..... G01N 15/0266 250/288
2012/0056085 A1* 3/2012 Giles ..... G01N 27/624 250/282

(Continued)

*Primary Examiner* — Jason McCormack
(74) *Attorney, Agent, or Firm* — Franco S. De LiGuori; DP IP Group

(57) ABSTRACT

A guide apparatus includes a vacuum compartment provided at a background pressure and having a gas inlet opening arranged for jetting a gas in the form of a free jet stream containing entrained ions into a vacuum chamber along a predetermined jetting axis. At least one duct housed within the vacuum chamber has a guide bore positioned coaxially with the jetting axis for receiving the free jet stream such that a supersonic free jet is formed in the duct with a jet pressure ratio $P_1/P_2$ restrained to a value that does not exceed $(A/a)^3$ to form a subsonic laminar gas flow inside of the duct for guiding the entrained ions, where $P_1$ is the pressure at an exit end of the gas inlet opening, $P_2$ is the background pressure, A is the cross sectional area of the bore, and a is the cross sectional area of the gas inlet opening.

21 Claims, 10 Drawing Sheets

(56) References Cited

U.S. PATENT DOCUMENTS

2012/0228492 A1* 9/2012 Franzen ..... H01J 49/401
250/288

* cited by examiner

CONTROL OF IONS

This application claims the benefit of U.K. Provisional Application No. 1211186.0, entitled, IMPROVEMENTS IN AND RELATING TO THE CONTROL OF IONS, filed on Jun. 24, 2012, commonly owned and assigned to the same assignee hereof.

FIELD

The present disclosure relates to techniques for mass spectrometer and ion mobility type equipment and components, and in particular, to the control of ions by gas dynamics and ion optical means.

BACKGROUND

Mass spectrometry (MS) and ion mobility spectrometry are analytical tools used for qualitative and quantitative elemental or molecular analysis of samples to measure the mass and size of ionized particles respectively.

In an effort to identify the nature of certain molecules in a given sample, a mass spectrometer may be used. Mass spectrometers require molecules or molecular species present in a sample to form gas phase ions. The ionized molecules, or analyte ions or simply analyte species, can consequently be directed by electrical fields to a mass analyzer device to separate in space and/or time due to their relative difference in mass-to-charge ratios. In turn, a separate detector device in the mass spectrometer is able to generate a mass spectrum. An ion mobility spectrometer also requires molecules or molecular species to form gas phase ions, which can consequently be separated in space and/or time due to their relative difference in size and/or charge. In turn, a separate detector device in an ion mobility spectrometer is able to generate a mobility spectrum. It may also be preferable to connect an ion mobility spectrometer to a mass spectrometer in tandem to obtain an ion mobility spectrum and a mass spectrum sequentially or simultaneously.

A mass spectrum is useful to derive information about the mass-to-charge ratios and in some cases the quantities of the various analyte ions of molecules or molecular species that make up the sample. A mass spectrum is also useful to derive information about the mass-to-charge ratios of fragment species comprising the analyte ions.

Similarly, an ion mobility spectrum provides information about the collisional cross-section and the charge state of analyte species. From the cross-section information one can infer a geometrical configuration, identify molecular conformation and or the charge state of the various analyte species. Preferably an ion mobility based spectrometer, for example a differential mobility spectrometer, is incorporated into a mass spectrometer to perform both forms of detection from which to draw inferences about complex samples of molecular species under analysis.

A prevalent configuration of a mass spectrometer uses an ionization source to introduce ions entrained in a gas in a high pressure environment (e.g., atmospheric pressure). Preferably ionization is set up to occur in the gas phase near the inlet opening of a first of a series of vacuum compartments. The first vacuum compartment in the series of vacuum compartments is the fore vacuum compartment. Each vacuum compartment maybe further divided into subcompartments operated at substantially the same pressure.

The series of vacuum compartments, which form a mass spectrometer, are operable to receive gas phase ions entrained in a flow of gas at the fore vacuum compartment and carefully designed to direct ions by ion optical means, for example by using electrical fields, into subsequent vacuum compartments of lower pressure. The aim in doing this is to efficiently transport the entire initial ion population from a high pressure region, for example the ionization source, to the high vacuum compartment enclosing the mass analyzer, whilst the initial gas load is progressively removed by means of vacuum pumps.

A critical part of a mass spectrometer is the design of the fore vacuum region where significant ion loses are known to occur near the inlet opening or the distal end of this region determined by a second pressure-limiting aperture defining the entrance to the second vacuum compartment. Yet another critical aspect of the performance of a mass spectrometer in terms of sensitivity and overall ion transmission is the gas dynamics design of the fore vacuum region. It is well appreciated that sensitivity is directly related to the properties of the gas flow, more precisely the formation of the free jet expansion flow and associated ion optical means arranged to focus ions under these conditions.

Consequently, it is desirable to be able to achieve improvements in the aerodynamic design of the fore vacuum region of a mass spectrometer to improve ion transmission and also achieve appropriate gas flow fields for performing ion separation based on ion mobility.

SUMMARY

Figure 1:
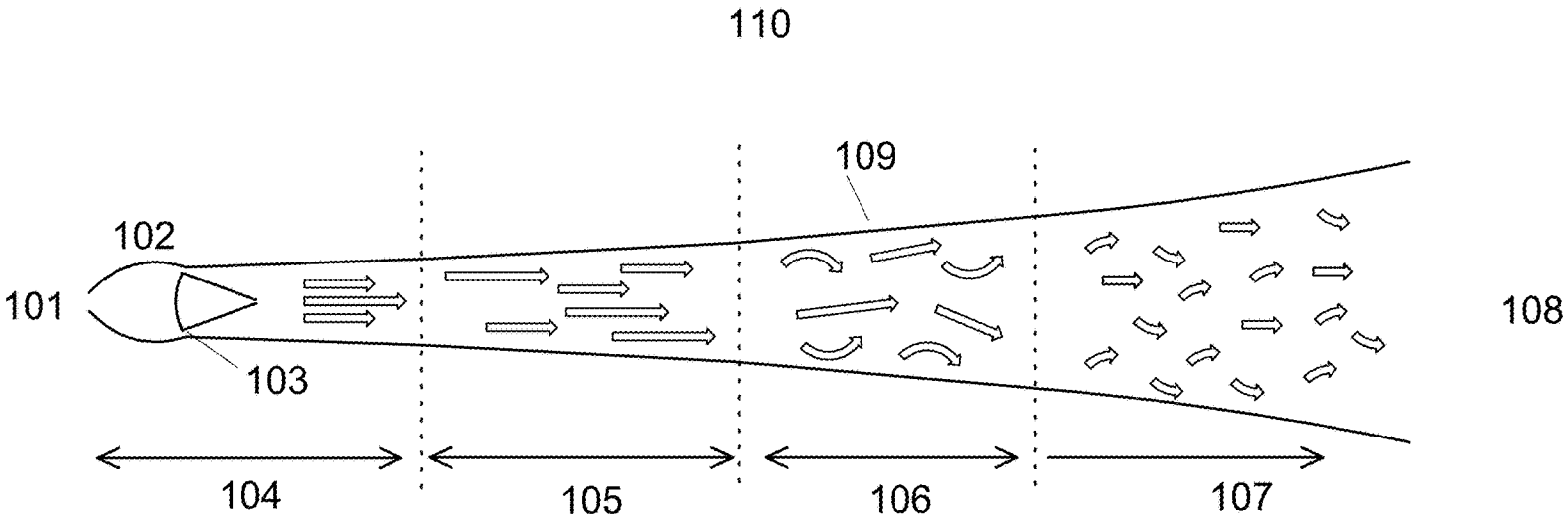
FIG. 1 (PRIOR ART)
FIG. 1 illustrates the properties and transformations of a free jet stream within a fore vacuum compartment of a conventional mass spectrometer.

The present disclosure is directed to a guide apparatus having a vacuum compartment which is at a background pressure and includes a gas inlet opening from which to jettison a gas in the form of a free jet stream from an exit end thereof into the direction of a bore of a duct. The duct is positioned along a trajectory axis of flow of the free jet stream and is dimensioned to restrain free expansion of the free jet stream to form a laminar gas flow pattern downstream from the entrance end of the bore.

The guide apparatus may be, for example, a mass spectrometer, a differential mobility spectrometer, or a mass spectrometer of the type including a compartment in a fore vacuum region which is configured to facilitate separation based on differential mobility properties of ions.

A variety of duct configurations are described and contemplated. Also described and further contemplated are a variety of configurations in which two or more ducts of the same or different geometries are communicably coupled to one another.

A duct may be configured to form a laminar gas flow pattern only, to maintain a laminar gas flow pattern only, to maintain or form a laminar gas flow pattern and also confine ions as is typical of an ion guide or other types of ion focusing devices. A duct may further alternatively be configured to maintain or form a laminar gas flow pattern and simultaneously facilitate separation based on differential mobility properties of ions.

In an exemplary embodiment, the laminar gas flow pattern is characterized by a coefficient value k, k being any value within a range of values within which an acceptable level of laminarity is provided, and the following condition is satisfied:

$$\frac{A}{a} = k^2 \times JPR^{1/3}$$

where (A) is the cross sectional area of the duct bore, (a) is the cross sectional area of the inlet opening, and JPR is the pressure ratio $p_1/p_2$, where (m) is the pressure at the exit end of the inlet opening and ($p_2$) is the background pressure of the vacuum compartment.

The present disclosure is also directed to a method of setting the background pressure in the vacuum compartment of a guide apparatus.

DETAILED DESCRIPTION

The word "exemplary" is used herein to mean "serving as an example, instance, or illustration." Any embodiment described herein as "exemplary" is not necessarily to be construed as preferred or advantageous over other embodiments. It is to be understood that the terminology used herein is for purposes of describing particular embodiments only, and is not intended to be limiting. The defined terms are in addition to the technical and scientific meanings of the defined terms as commonly understood and accepted in the technical field of the present teachings.

As used in the specification and appended claims, the terms "a", "an" and "the" include both singular and plural referents, unless the context clearly dictates otherwise. Thus, for example, "an apparatus" or "a device" includes one apparatus or device as well as plural apparatuses or devices.

Furthermore, the terms "duct", "conduit", and "guide" are used interchangeably, unless otherwise specifically indicated.

In the following detailed description, for purposes of explanation and not limitation, representative embodiments disclosing specific details are set forth in order to provide a thorough understanding of the present teachings. Descriptions of known systems, devices, materials, methods of operation and methods of manufacture may be omitted so as to avoid obscuring the description of the example embodiments. Nonetheless, systems, devices, materials and methods that are within the purview of one of ordinary skill in the art may be used in accordance with the representative embodiments.

The present disclosure aims to address the need of being able to achieve improvements in the aerodynamic design of the fore vacuum region of a mass spectrometer. More specifically the present disclosure aims to address the need of being able to achieve low pressure laminar gas flows entrained with ions as a means for improving instrument sensitivity and/or performing ion mobility based separation.

Figure 12:
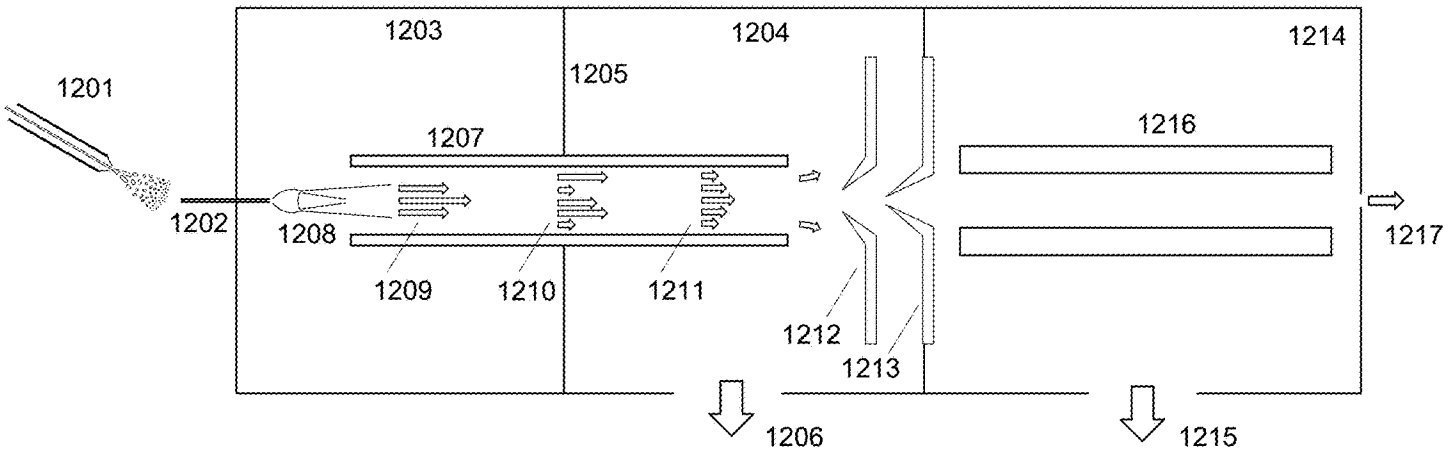
FIGS. 12-14 are high level instrument architecture and gas flow diagrams of different mass spectrometer configurations in accordance with an exemplary embodiment herein.

FIG. 12—the operation of which is to be explained in greater detail below—is a high level architecture of a mass spectrometer configured in accordance with an exemplary embodiment herein.

The formation of the free jet expansion and the transitions of the gas flow established in the new design of a fore vacuum compartment and associated ion optical means configured in accordance with an exemplary embodiment of the present invention are highlighted.

As can be seen in FIG. 12, an ionization source 1201 is provided that introduces analyte species in the form of a spray in the vicinity of an inlet opening. The inlet opening is, for example, a capillary inlet 1202 forming the entrance to fore vacuum sub-compartment 1203.

Suction brought on by the lower pressure conditions in fore vacuum sub-compartment 1203, will cause the gas entrained with analyte species in the form of charged droplets to be introduced in the form of a free jet stream into fore vacuum sub-compartment 1203. This free jet stream will naturally follow a trajectory coaxial with the inlet capillary or other types of inlet openings from which it is jettisoned.

The present disclosure concerns the introduction of a duct 1207 into the line of trajectory of the free jet expansion, also termed the free jet stream. In the example illustration, duct 1207 extends co-axially along the trajectory path of the free jet stream. Duct 1207 simultaneously extends across the fore vacuum sub-compartment 1203 toward an exit end thereof defined by separation wall 1205. Separation wall 1205 defines a physical barrier separating vacuum sub-compartment 1203 from vacuum sub-compartment 1204 in series therewith forming a single compartment operated at a substantially uniform pressure. Further as shown, duct 1207 is communicable coupled and extends further co-axially into vacuum sub-compartment 1204.

The use of a duct in the path of trajectory of a free jet stream provides significant benefits associated with improvements in the aerodynamic characteristics/design of the fore vacuum compartment by forming low pressure laminar flow conditions that enhance ion transmission and/or perform ion mobility based separation of analyte species.

To understand these benefits, attention is drawn to prior art FIG. 1.

FIG. 1 illustrates the properties and transformations of a free jet stream within fore vacuum compartment 110 of a conventional mass spectrometer. Conventional mass spectrometers do not include a duct as presently proposed and explained below in particular for the formation of low pressure laminar gas flow or the suppression of the transitional and turbulent characteristics of free jet expansion flows.

Referring to FIG. 1, fore vacuum compartment 110 is a compartment that is typically maintained at an intermediate pressure level of around 1 mbar pressure. The pressure difference established between the ionization source (not shown), typically operated at atmospheric pressure and the fore vacuum region established across the inlet opening 101, is the driving mechanism for the formation of the free jet expansion inside the fore vacuum compartment. The free jet stream ejected into prior art vacuum compartment 110 undergoes substantially different transformations compared to the free jet stream shown in FIG. 12.

As the free jet stream undergoes expansion in space it defines a boundary 109 with respect to the background gas. The boundary 109 is radially disposed about the expansion axis of the free jet stream which extends from an inlet opening, represented by numeral 101, and which inlet opening 101 corresponds to the exit end of a capillary, aperture or orifice in communication with the ionization source.

Referring back to FIG. 1, the free jet stream undergoes specific transformations highlighted in consecutive regions 104, 105, 106 and 107. Each transformation region refers to different states of the free jet expansion where the characteristic properties of the flow are altered.

It should be mentioned that the pressure difference established between the ionization source and the fore vacuum region of a mass spectrometer is substantial to accelerate the gas to supersonic speeds. The detailed characteristics of the free jet expansion are primarily a function of the inlet opening 101 dimensions, the background pressure in the fore vacuum region 110 and the nature of the gas. The high speed gas is progressively decelerated and equilibrated to the conditions imposed by the background gas.

The equilibration process of the free jet expansion flow is known to create turbulence in the far-field region of the jet, as shown in region 107, which is associated with ion scattering and extensive diffusion of entrained analyte species. Diffusive ion populations are difficult to manipulate using electric fields and other ion optical means employed in a mass spectrometer or an ion mobility system, particularly in situations where such turbulent flows persist throughout. Ion transmission is therefore significantly reduced and instrument sensitivity is poor.

At the exit end 101 of an inlet opening in communication with the ionization source, where the inlet is a nozzle or capillary with a sonic outlet, a free jet stream reaches the speed of sound. The sonic speed is defined as the mean translational velocity equal to the local speed of sound and characterized by a Mach number equal to unity, M=1. In the case where the gas jet stream is introduced into the fore vacuum region of a mass spectrometer or an ion mobility apparatus, such as vacuum compartment 110, it is said to undergo adiabatic expansion. The free jet stream, in turn, is also referred to as under-expanded (under-expanded gas flow). Another term for describing an adiabatic expansion of a gas flow is super-sonic jet expansion.

Beyond the sonic surface near the outlet of a nozzle or capillary (orifice 101), a free jet stream experiences significant acceleration and can reach speeds far above the local speed of sound. At this point in space, supersonic gas flow conditions will cause shock waves. Shock waves are discontinuities in an attempt of the under-expanded gas flow to arrive into equilibrium with the background gas pressure and temperature.

More specifically, shock waves are initiated by rarefaction waves (as opposed to compression waves) produced by a reduction in the density of the gas by its transformation into a free jet stream as it exits inlet opening 101.

Rarefaction waves propagate off the trajectory axis and are reflected off the boundaries of the free jet 109 to produce compression waves. These compression waves converge to form an oblique shock; also known as conical or incident shock.

Conical shocks undergo regular reflection when reaching the jet trajectory axis where they in turn form a diverging (or reflected) shock. A diverging shock may undergo reflections at the boundaries of the free jet 109, to form a second generation of compression waves thus causing the process to repeat. Oblique shocks is a term used to characterize the structure of the particular type of supersonic free jet expansions produced here, and are often accompanied by the presence of a diamond shock pattern.

When a pressure difference between the inlet 101 and vacuum compartment 110 is high the rarefaction waves propagate at large angles of incidence yielding Mach reflections, i.e., a strong shock normal to the direction of flow. It is further observed that smaller angles of incidence are also present yielding regular compression waves.

A narrow region in space where a Mach disk shock meets an oblique shock with additional reflection shocks is termed a triple point, and is represented by reference numeral 103. The formation of a barrel shock boundary (represented by reference numeral 102) is a result of the accumulation of rarefaction and compression waves.

A Mach disk is a thin region of high density, pressure, temperature and strong velocity gradients. Upstream from the Mach disk, the flow properties of the free jet stream are independent of the pressure in vacuum compartment 110. The Mach disk is perpendicular to the direction of the free jet expansion and defines the onset of the silent zone, which is graphically represented by the triangular like surface region in FIG. 1.

Behind the Mach disk, inside the silent zone, the velocity becomes subsonic and undergoes a gradual acceleration due to the shear forces exerted by the high velocity boundary 109 of the free jet stream. The high velocity boundary is defined by high density regions surrounding the core of the free jet stream which carries much of the mass flow around the Mach disk.

Reflections originating at the triple point 103 are confined between the inner and outer shear layers of high velocity boundary 109 and gradually diffuse into the free jet stream. This diffusion results in free jet instabilities and gas turbulence on and about boundaries 106 and 107, respectively.

The onset of instabilities begins in transformation region 106. Here, the free jet stream appears in "transition" or in "transitional state", while in region 107 the free jet stream is very well under turbulence ("turbulent state"). Ion optical means to manipulate ion motion and direct ions in subsequent vacuum compartments through narrow apertures typically employed in prior art mass spectrometers and/or ion mobility devices are disposed in region 108 where turbulent gas flows are present.

It is known to associate free jet expansion as a function of the presence and nature of a Mach disk (and/or whether a supersonic free jet stream will reveal the presence of a diamond shock pattern). Specifically, there is a known correlation of Jet Pressure Ratio (JPR), defined as:

$$JPR=p_1/p_2, \quad \text{Equation (1)}$$

where $p_1$ is the pressure at the inlet opening (the pressure at the sonic surface in case of sonic under-expanded free jet streams), and $p_2$ is the pressure in vacuum compartment 110 (background pressure).

It is also known to employ supersonic nozzles as inlet openings having a divergent tip at the exit end that are capable of producing free jet streams with speeds above M=1 and whose distance to the Mach disk is greater.

Conventional wisdom is that the presence of diamond shock patterns occur only at low JPR values (<5), and that the formation of a clear Mach disk is evident at higher JPR (>5).

It was also observed that single sonic orifices are able to reach JPR values of 40 or greater when pressure in vacuum compartment 110 is near 1 mbar, which value is a practical lowest possible pressure attainable at a fore vacuum compartment of a mass spectrometer connected to a mechanical pump.

Values of JPR for systems equipped with an inlet capillary may be significantly lower due to the pressure drop across the capillary length. Low JPR values may also be obtained by increasing the pressure inside vacuum compartment 110, or by using enlarged inlet apertures, typically greater than 0.6 mm.

It was further observed that a critical aspect with respect to the formation of supersonic free jets—which appear to have a significant impact on the ion transmission characteristics of mass spectrometers and the performance of ion mobility spectrometers operated in the fore vacuum compartment—is the very transitions which a free jet undergoes as it travels along the trajectory axis and moves across the transformation regions to finally arrive at a fully turbulent state where ion scattering and diffusion is enhanced and ion optical means can no longer maintain transmission through narrow apertures in region 108.

The onset of jet instabilities and the generation of transitional and turbulent states of the flow, along far-field transformational regions 106 and 107, respectively, significantly impact transmission efficiency of ions through narrow apertures disposed in region 108 to signify the entrance to a subsequent vacuum compartment operated at lower pressure. Ion diffusion and ion beam broadening are augmented by the presence of transitional and turbulent gas flow states and, in turn, reduce instrument sensitivity.

To address these problems, it was discovered that the use of a duct, or similar guide, in a fore vacuum compartment, as shown, for example, in FIG. 12, it becomes possible to channel a free jet stream so as to achieve laminar gas flow from a free jet expansion. In so doing, severe ion losses associated with ion scattering and enhanced diffusion from occurring downstream in a fore vacuum compartment in the presence of turbulent gas flow can be prevented.

Hereafter are described varying implementations which employ one or more guides, of varying configurations and sizes, in accordance with exemplary embodiments of the present invention.

The techniques described achieve laminar gas flow and improve transmission of ions entrained in a gas flowing within a guide and through subsequent ion optical components including pressure limiting apertures or orifices presented with such a flow.

In one scenario, the guide is located solely within the confines of a fore vacuum compartment.

In an alternate scenario, the guide extends from a fore vacuum sub-compartment into a second vacuum sub-compartment operated at substantially equal pressures.

In an exemplary embodiment, the guide is shaped as a duct or conduit and includes a bore having a cross-section which is selected to accept the entire free jet stream at the entrance end and produce a subsonic (M<1) laminar flow and the distal end where the formation of transitional or turbulent gas flow that might otherwise develop in the far-field region of an under-expanded free jet stream are suppressed.

The guide is preferably disposed so as to be axially aligned with the inlet opening through which a gas is received and discharged in the form of a free jet stream into the fore vacuum compartment.

The present disclosure is also directed to techniques for suppressing the formation of transitional and turbulent regions of gas flow to reduce ion scattering and diffusion to enhance the focusing properties of ion optical means. The use of a duct allows for laminar flow conditions to be established when specific conditions are met. It has been observed and experimentally shown that for a fixed cross-sectional area (a) of the inlet opening and a fixed cross-sectional area (A) of the duct, there exists a proportionality coefficient relating the value of the JPR to the ratio $(A/a)^3$. This proportionality coefficient defines a range of background pressures inside the vacuum compartment for a given physical geometry which will result in laminar flow inside the fore vacuum compartment including a guide apparatus. Stated in another way, in a mass spectrometer or other ion mobility devices or combinations thereof employing a duct as proposed herein, it is possible to achieve optimum (or near optimum) vacuum compartment pressure; optimum being a pressure level that permits laminarization of the free jet stream and/or suppression of the onset of the transitional and turbulent states of the gas flow.

In an alternate scenario, instead of adjusting the pressure of the fore vacuum compartment for a given set of duct and inlet opening dimensions to achieve a laminar flow, the cross section of the duct can be selected to operate within a desirable pressure range.

Specification of duct and inlet opening dimensions based on the operating fore vacuum pressure under consideration, for example operating pressures greater than 10 mbar or pressures greater than 100 mbar, is a significant tool for designing systems to be operable under conditions non-typical to those of standard mass spectrometers.

In yet another alternate scenario, a significant variation in the inlet opening pressure may be realized by shaping an inlet skimmer electrode or the distal end of an inlet capillary to alter the pressure at the sonic surface.

A guide apparatus configured as proposed herein and described in greater detail below is effective in achieving laminar flow conditions in an intermediate pressure vacuum compartment, and more particularly, in the fore vacuum compartment of a mass spectrometer operated within a pressure range of 0.1 mbar to 200 mbar, more preferably within a range of 1 mbar to 100 mbar and most preferably within a range of 10 mbar to 50 mbar.

It has been observed that a duct, and specifically the inner bore of such a duct, is able to physically restrain expansion of a free gas stream before naturally occurring expansion reaches the point in which flow instabilities are introduced, such as those depicted in regions 106 and 107 of FIG. 1.

It has further been observed that the laminar gas flow produced by the presence of a duct acting on a free jet stream can be transformed into a fully-developed or steady-state laminar flow.

The ability to restrain expansion at a particular point in the trajectory path of a free jet stream involves a coordinated selection of values, including the characteristic dimensions of a free jet stream (which are a function of the JPR) and the dimensions of the inlet opening and the guide apparatus. Taken together, these values help define the corresponding inner surface boundary of the guide within which the free jet stream is contained and ultimately transformed into a laminar gas flow state.

The diameter or cross section area of a duct may be uniform or non-uniform in a lengthwise direction. In one example, the diameter of a guide may become smaller (converge) with increasing distance along the axis of the guide in a direction distal from the inlet source opening.

In accordance with an exemplary embodiment, the pressure in the vacuum compartment $p_2$ may be selectively set by a controller (not shown) in order to further "restrain" the jet pressure ratio, JPR, to within one or more selectable range values. The range values are preferably values lower than the value of the cubed ratio $(A/a)^3$.

In one example, three selectable range values are provided. The first range generates JPR values proportional to the cubed ratio $(A/a)^3$ by a factor within the range $1.4\times10^{-3}$ to $2\times10^{-7}$, the second within the range $6.4\times10^{-5}$ to $5.6\times10^{-7}$, and the third within the range $4.6\times10^{-6}$ to $3.2\times10^{-6}$.

Furthermore, a guide apparatus may include a control apparatus arranged to implement these controls. This may be an active control element in which the fore vacuum compartment pressure $p_2$ is monitored and adjusted by controlling the pumping speed of the pump. Alternatively, the control may be a control element in which the fore vacuum compartment and inlet opening are constructed to automatically or inherently achieve the laminarized flow at a desired pressure.

In an example embodiment, the vacuum compartment is defined by adjoining sections, or vacuum sub-compartments. The first of such sections includes the inlet opening in communication with the ionization source. Both sections may include separate outlet ports to connect a pumping device and facilitate setting pressure levels in each compartment independently.

In an example embodiment, a desired duct length is 50 mm or greater.

In one scenario, the duct is also an ion guide formed from a series of conductive ring electrodes separated by electrical insulators and configured to receive electrical potentials from a field generator externally coupled thereto in a known manner.

The field generator may be configured to apply a DC electrical potential across the ring electrodes so as to generate an electrical field within the guide, in order to radially focus entrained ions in the flowing gas in a known manner.

The field generator may also be arranged to apply a DC electrical potential in a direction opposite to the direction of gas flow to selectively transmit ions within a certain ion mobility range.

The field generator may be arranged to generate a periodic electrical field by application of first RF (radio frequency) signal to a first set of ring electrodes and a second phase-shifted RF signal to a second set of ring electrodes to focus entrained ions upon the axis of the bore of the guide. Alternatively, the field generator may be arranged to apply any DC (direct current) electrical field and a periodic electrical field simultaneously.

In yet another scenario, the guide apparatus may be operated at elevated temperatures to promote desolvation of charged droplets and cluster ions within the guide.

In addition, the guide apparatus may include at least one additional duct arranged coaxially at an output end of a first duct to receive and sustain a laminar gas flow therealong.

The guide apparatus may include any one of an ion funnel, a q-array or any other intermediate pressure (>0.1 mbar) RF focusing device known to those skilled in the art, arranged coaxially or with an offset with respect to one or more guides at an output end of the end-guide to achieve laminar flow conditions at a distal end section associated therewith.

The guide apparatus may be a vacuum interface apparatus, such as that used to provide a vacuum interface for a mass spectrometer or other gas phase ion analysis equipment, for example an ion mobility based spectrometer.

In a further aspect, the guide apparatus is a differential mobility spectrometer, preferably but not exclusively coupled to a mass spectrometer and includes an ion inlet opening for accepting ions therein. In this scenario, a first guide is located between the gas inlet opening and the ion inlet opening of the differential mobility spectrometer with its bore positioned in axial alignment with the ion inlet opening to receive the free jet stream entrained with ions and produce a subsonic laminar flow of gas.

The differential mobility spectrometer apparatus is preferably arranged to operate at a vacuum pressure therein substantially matching the fore vacuum pressure or the pressure in the first vacuum compartment.

The differential mobility spectrometer apparatus may comprise at least two elongated electrodes arranged to confine ions entrained within the laminar flow established within the guide and sustained across the differential mobility spectrometer.

In another implementation, a mass spectrometer vacuum interface is provided which comprises an ionization source controllable to provide ions within a gas at a high pressure (the ionization source pressure), a vacuum chamber in communication with said ionization source comprising a gas inlet opening system having a cross sectional area (a) to achieve a first pressure ($p_1$) at the outlet of the gas inlet system and arranged for jetting said gas containing entrained ions from the ionization source into the vacuum chamber along a predetermined jetting axis, an ion guide housed within the vacuum chamber evacuated to a second pressure ($p_2$) and comprising a guide bore having a cross sectional area (A) and positioned coaxially with the jetting axis of gas inlet system for receiving the jet of gas, wherein the vacuum interface is configured to establish a subsonic laminar flow in the guide by control of the guide and gas inlet system cross sectional area ratio A/a to be proportional to the outlet of gas inlet opening system and vacuum chamber (background) pressure ratio $p_1/p_2$ raised in the power of 1/3 through a coefficient ($k^2$) with a value of no less than 9 and no more than 169.

In the above scenario, the value of the coefficient ($k^2$) is preferably no less than 25 and no more than 121, and preferably approximately 64. The laminar flow may be presented at the entrance of (and preferably maintained throughout the length of) a differential mobility spectrometer operated at or near vacuum pressure $p_2$.

In another aspect, a mass spectrometer is provided and includes an ionization source that generates ions at elevated pressure, and a vacuum compartment or chamber comprising an inlet opening to form an (e.g. axi-symmetric) under-expanded jet into the vacuum chamber. The under-expanded jet may be seeded with the ions.

The vacuum chamber may further comprise a first vacuum sub-compartment and a second vacuum sub-compartment in communication with the first through a coaxial duct. The under-expanded jet may discharge into the coaxial duct while pumping is preferably but not exclusively applied in the second vacuum sub-compartment. The length and cross sectional area of the duct are preferably configured to transform/convert the supersonic flow in the near-field region of the under-expanded jet into a subsonic laminar flow toward the end of the duct (e.g. to suppress the onset of transitional and turbulent flow in the far-field region of the free jet). The first and second vacuum sub-compartments may be operated at substantially the same pressure.

The cross sectional area (lateral dimensions) of the duct may be equal or greater to the cross section the under-expanded jet exhibits in the steady-laminar region of the flow.

The cross sectional area of the duct may be equal or greater to the cross sectional area the under-expanded jet exhibits in the unsteady-laminar region of the flow.

The cross sectional area of the duct is preferably equal to or greater than the cross sectional area the under-expanded jet exhibits in the transitional region of the flow.

The radial velocity profile of the steady-laminar flow toward the end of the duct is preferably substantially parabolic or quasi-parabolic.

The stream-wise velocity of the steady-laminar flow toward the end of the duct preferably varies across the velocity profile by less than 50 m/s.

Local variations in the stream-wise velocity profile of the unsteady-laminar flow toward the end of the duct are preferably less than 100 m/s.

The duct may be comprised of a series of conductive rings separated by thin insulators which form a duct.

A progressively accelerating field may be generated by application of DC potentials across the rings to focus ions radially (e.g. negative second derivative of potential along the axis).

In another aspect, a mass spectrometer is provided which includes an ionization source that generates ions at elevated pressure, and a vacuum chamber comprising an inlet to form an (e.g. axi-symmetric) under-expanded jet into the vacuum chamber. The under-expanded jet may be seeded with the ions. The vacuum chamber may further comprise a coaxial duct and a differential mobility spectrometer in tandem which form an elongated channel. The under-expanded jet preferably discharges into the coaxial duct. The length and cross sectional area of the duct are preferably configured to transform the supersonic flow in the near-field region of the under-expanded jet into a subsonic laminar flow at the far-field region toward the end of the duct. The laminar flow may be maintained throughout the length of the differential mobility spectrometer.

The differential mobility spectrometer may comprise a series of elongated electrodes arranged circumferentially about a common axis forming a multi-pole and to which appropriate potentials may be applied to generate an alternating asymmetric dipole field and a scanning DC field to manipulate ion motion.

Additional higher-order (e.g. quadrupole) RF and/or DC fields can be produced within the multi-pole to superimpose a focusing action during separation of ions in the differential mobility spectrometer.

The flow at the entrance of the differential mobility spectrometer is preferably steady-laminar and characterized by a quasi-parabolic velocity profile.

The flow at the entrance of the differential mobility spectrometer is preferably unsteady-laminar and characterized by a quasi-parabolic velocity profile.

The duct may be comprised of a series of conductive rings separated by thin insulators which form a sealed (e.g., air-tight or fused) structure.

A progressively accelerating field may be generated by application of DC potentials across the rings to focus ions radially (e.g. negative second derivative of potential along the axis).

A periodic electrical field may be generated by application of first RF signal to a first set of ring electrodes and a second phase-shifted RF signal to a second set of ring electrodes to focus ions on axis.

The progressively accelerating field and the periodic electrical field may be applied simultaneously.

The coaxial duct in series with the differential mobility spectrometer may be positioned upstream from an ion funnel, a q-array or other type of RF focusing devices to eliminate high speed transitional and turbulent flows and minimize ion losses near exit and/or limiting apertures.

The coaxial duct in series with the differential mobility spectrometer may be positioned upstream from a set of apertures supplied with DC potentials used to guide ions into the next vacuum region.

The above described apparatus and methodologies serve to control and eliminate the transitional and turbulent effects on gas flow in the far-field region of under-expanded jets, thereby enhancing ion transmission through narrow apertures located further downstream in the first vacuum region by significantly reducing the effect of ion diffusion and ion beam broadening. There is further suggested to use specially configured electric field distributions in the presence of laminar gas flow fields to further enhance ion transmission.

In accordance with a further exemplary embodiment, the guide is an elongated duct and provided to contain the under-expanded jet formed in the fore vacuum region of a mass spectrometer and to eliminate the transitional and turbulent flow regimes established in the far-field region of the flow, which are associated with extensive ion diffusion and reduce instrument sensitivity.

The free shear layer where the onset of jet instabilities occur is replaced by the physical boundary of the duct, which confines the gas and retains flow laminarity thereby minimizing ion dispersion/scattering via collisions. Transformation from the supersonic free jet expansion regime to a subsonic steady- or unsteady-laminar flow is developed smoothly across the length of the duct and in the absence of transitional and turbulent gas motion at pressures of the order of 1 mbar or greater. The generation of subsonic laminar flow and the elimination of turbulent gas motion within the duct are demonstrated experimentally.

In yet a further exemplary embodiment, the free jet is contained by a series of conductive rings spaced apart by insulators to form a duct. A progressively accelerating DC axial potential distribution and/or appropriate RF potentials applied to the rings is used to focus ions on axis and enhance ion transmission through narrow apertures located in the far-field region of the free jet. The extent of ion focusing in a subsonic laminar flow under the presence of electric fields is considerably enhanced compared to intermediate pressure flows where turbulence is normally the dominant factor for ion beam broadening. Enhanced transmission and greatly improved sensitivity are therefore obtained.

Referring back to FIG. 1, it has been explained so far that a free jet stream undergoes a number of flow transformations 104, 105, 106, 107 associated with the formation of a sonic under-expanded free jet commonly developed in the fore vacuum compartment or region of a mass spectrometer equipped with an atmospheric pressure ionization source. Typically, nitrogen or air is allowed to expand freely in a low pressure vacuum compartment through an aperture or a narrow capillary, termed the inlet opening 101.

The ratio of the pressure at the exit of the inlet opening 101 and the pressure of the vacuum compartment, or the background pressure determines the detailed structure of the free jet, the dimensions of the barrel shock 102 and the formation of a Mach disk in front of the silent zone near the triple point 103. In a near-field transformation region 104 of the free jet stream, the discontinuity at the Mach disk separates the flow into supersonic and subsonic regions.

Consecutive Mach disks with smaller radial dimensions and/or repetitive diamond shock patterns can be developed further downstream depending on the jet pressure ratio. In front of the Mach disk the gas moves in orderly layers without lateral mixing and the flow can be characterized as supersonic steady-laminar 104.

Local variations in the magnitude of the velocity of the gas are observed further downstream in transformation region 105 where the high speed boundaries of the free jet stream merge with the low speed fraction near the axis downstream from the shock waves.

These variations vary over time and the flow is characterized as unsteady-laminar. Flow instabilities originate in the free shear layer (boundary 109) of the jet stream and propagate toward the axis of symmetry. This region 106 of the flow is termed transitional and comprises an outer mixing layer and an inner unsteady-laminar layer merging over distance. Local and time variations in the magnitude of the flow velocity are at a maximum throughout transformation region 106. The free jet stream becomes fully turbulent further downstream in region 107 where randomness, recirculation and eddies have spread across the entire flow.

In this turbulent state, the free jet stream moves forward at a reduced speed compared to the flow upstream. It is the transitional and turbulent flow regimes in the far-field transformation regions 106 and 107, respectively, of the free jet stream that cause extensive ion diffusion and beam broadening, which cannot be entirely counteracted by the application of external electrical fields, especially at pressures around 1 mbar or greater.

It has been established, in connection with the above introductory discussion of the exemplary embodiment shown in FIG. 12, that it is possible to avoid the transformation to a turbulent flow in the far-field region of a sonic under-expanded free jet stream and consequently reduce or entirely remove ion losses in ion optical systems disposed further downstream and near pressure limiting apertures used for separating consecutive vacuum compartments operated at lower pressure.

Figure 2:
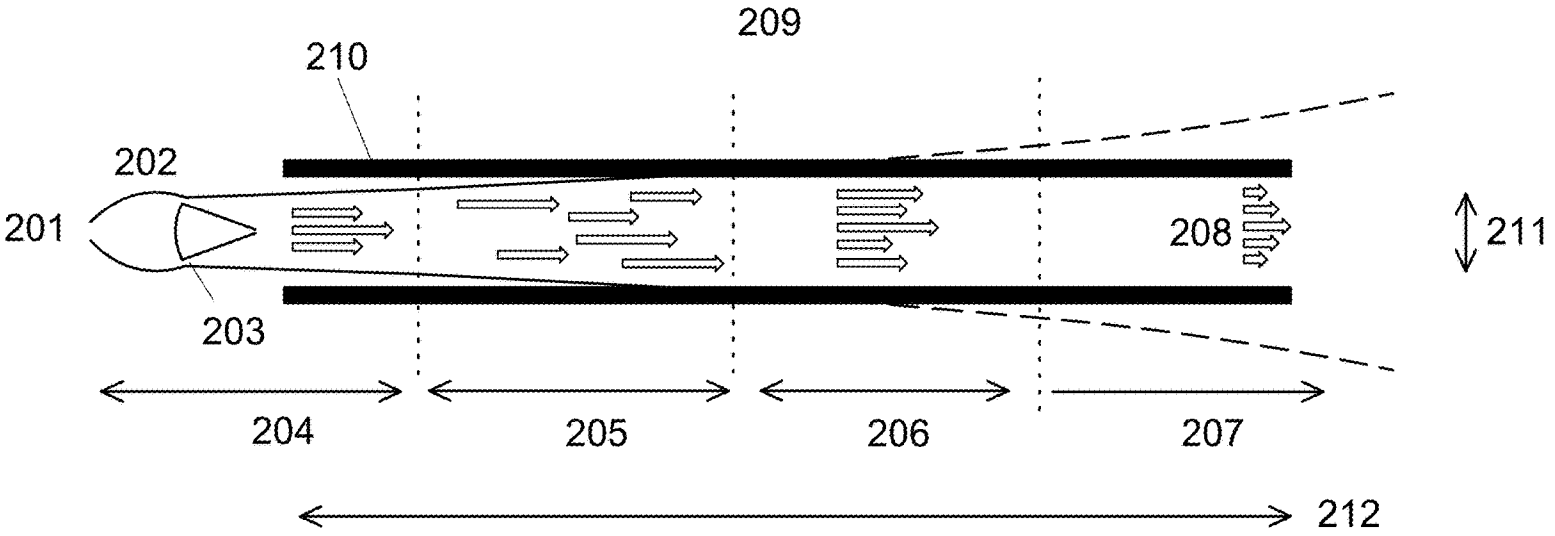
FIG. 2 illustrates the transformations of a free jet stream flow of gas directed into a duct disposed in a fore vacuum compartment to induce a laminar gas flow pattern in accordance with an exemplary embodiment.

FIG. 2 illustrates the transformations of a free jet stream flow of gas directed into a duct 210 disposed in a fore vacuum compartment 209 to induce a laminar gas flow pattern 208 in accordance with an exemplary embodiment.

Referring to FIG. 2, there is shown the same supersonic free jet stream as that in FIG. 1 discharging into a duct 210, shown as an elongated duct, where in this example the lateral dimensions 211 of duct 210 are greater than those determined by the boundaries of the jet in near-field transformation region 204.

As with FIG. 1, the free jet stream emanates through an aperture or a narrow capillary represented by inlet opening 201, forming a barrel shock 202 and a Mach disk followed by the silent zone near the triple point 203, where the flow undergoes a transformation from the supersonic into the subsonic flow regime. The steady-laminar region of the flow and the recirculation zone surrounding the barrel shock remain unaffected. The free shear layer of the jet encounters the physical boundary of the duct preferably in the unsteady-laminar transformation region 205, thus obstructing the onset of instabilities commonly observed in the transitional regime (transformation region 106 of FIG. 1) of the flow developed in the shear layer further downstream. The transitional stage flow is therefore channeled along transformation region 206 and—provided the duct has a sufficient length 212—a subsonic laminar flow is developed about the exiting transformation region 207 of the fore vacuum compartment 209 with a quasi-parabolic low velocity profile (represented by numeral 208).

The lateral dimensions 211 of duct 210 depend on the ratio of the pressure at the exit of the gas inlet opening and the pressure of the fore vacuum compartment 209, namely the jet pressure ratio or JPR as discussed above. High pressure ratios are established when inlet apertures or skimmer cones are employed and the extended radial size of the Mach disk requires a duct with greater lateral dimensions to be employed for gas jet flow containment.

A significant pressure drop is established across the length of an inlet capillary and therefore the smaller values for JPR require that a duct with reduced lateral dimensions is most preferably used instead.

There exists a relationship between the dimensionless cross section area of the duct and inlet opening and the jet pressure ratio, JPR, necessary to circumvent ion losses and strong ion diffusional effects related to the onset of transitional and turbulent flows in the far-field region of the jet and also associated with the formation of laminar low pressure flow. The relationship is derived experimentally and relates the cross sectional area of the duct normalized to the inner cross sectional area of the inlet opening, with the value of the JPR through a coefficient k:

$$\frac{A}{a} = k^2 \times JPR^{1/3} \qquad \text{Equation (2)}$$

where A is the cross sectional area of the duct bore, a is the cross sectional area of the inlet opening or the inner bore of the capillary and k is a coefficient determined experimentally. For round inlet openings, apertures or orifices, including cylindrical capillaries and cylindrical ducts or conduits respectively acting as guides, the relationship takes the form:

$$D = d \times k \times JPR^{1/6} \qquad \text{Equation (3)}$$

where D is the diameter of the duct bore and d the diameter of the inlet aperture or inner diameter of the capillary bore defining the inlet aperture. Steady-laminar flow conditions toward the end of an elongated duct, preferably in the subsonic flow regime, and in the absence of turbulence across the entire length of the channel, are developed for a value of k~8, with the dimensions for D and d given in mm.

A range of values for the coefficient k spanning from 5 to 11 has been determined where the flow toward the end of the duct will be steady-laminar and a greater range for k extending down to from 3 and up 13 where the flow will remain unsteady-laminar.

Flows developed within the range of k=8±5 are desirable for suppressing the onset of turbulence in order to enhance focusing of ions and improve ion transmission through narrow apertures within the laminar flow regime. More preferably, flows developed within the range of k=8±3 are desirable for transforming a supersonic jet into a subsonic steady-laminar flow. Most preferably, gas flow for values of k approximately equal to 8 (eight) are desirable for transforming a supersonic jet into a subsonic steady-laminar flow within a length of the duct.

Figure 3:
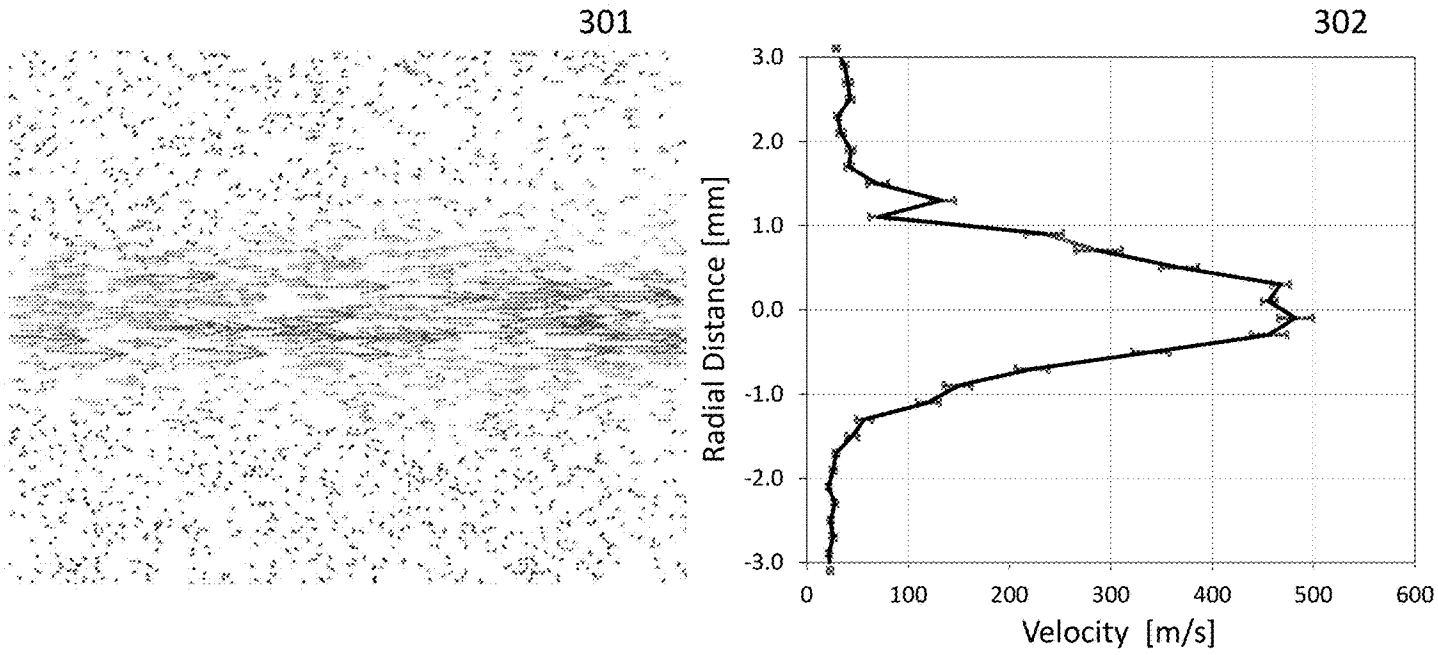
FIGS. 3-5 are examples of the gas flow established within a cylindrical duct of a mass spectrometer in accordance with an exemplary embodiment.

An example of the gas flow established within a cylindrical duct and measured experimentally based on the Particle Tracking Velocimetry (PTV) method is discussed with reference to FIGS. 3 to 5. The diameter of the duct employed in the experiment is 5 mm and the background pressure is set to 50 mbar with a value of JPR ~4.

Referring to the figures, the duct is positioned 10 mm downstream from the outlet of a 0.5 mm inner diameter capillary. The velocity vector field is visualized at the entrance of the duct 301 for which the accompanying velocity profile 302 is shown. Here, variations in the magnitude of the velocity which reveal the supersonic unsteady-laminar character of the flow. The entire free jet stream discharges into the duct with no interruptions.

Figure 4:
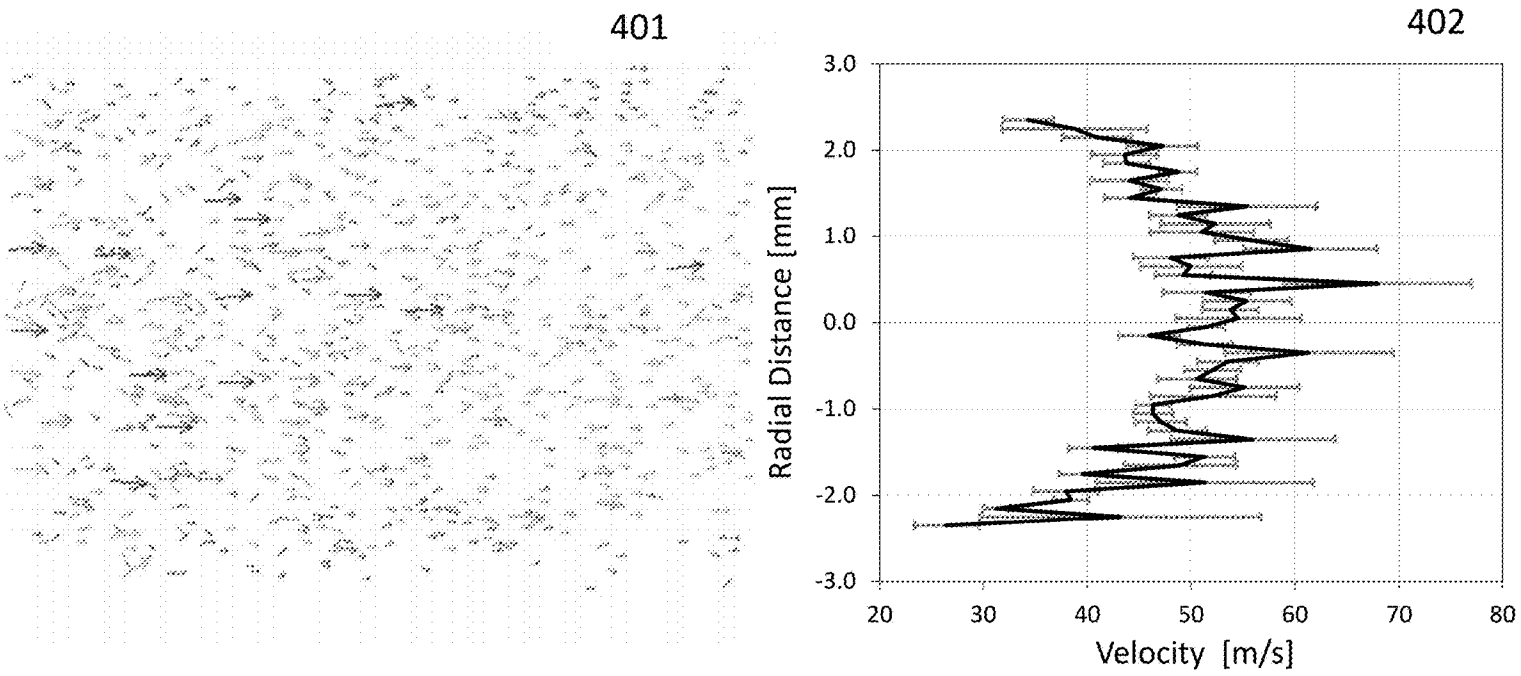
Figure 5:
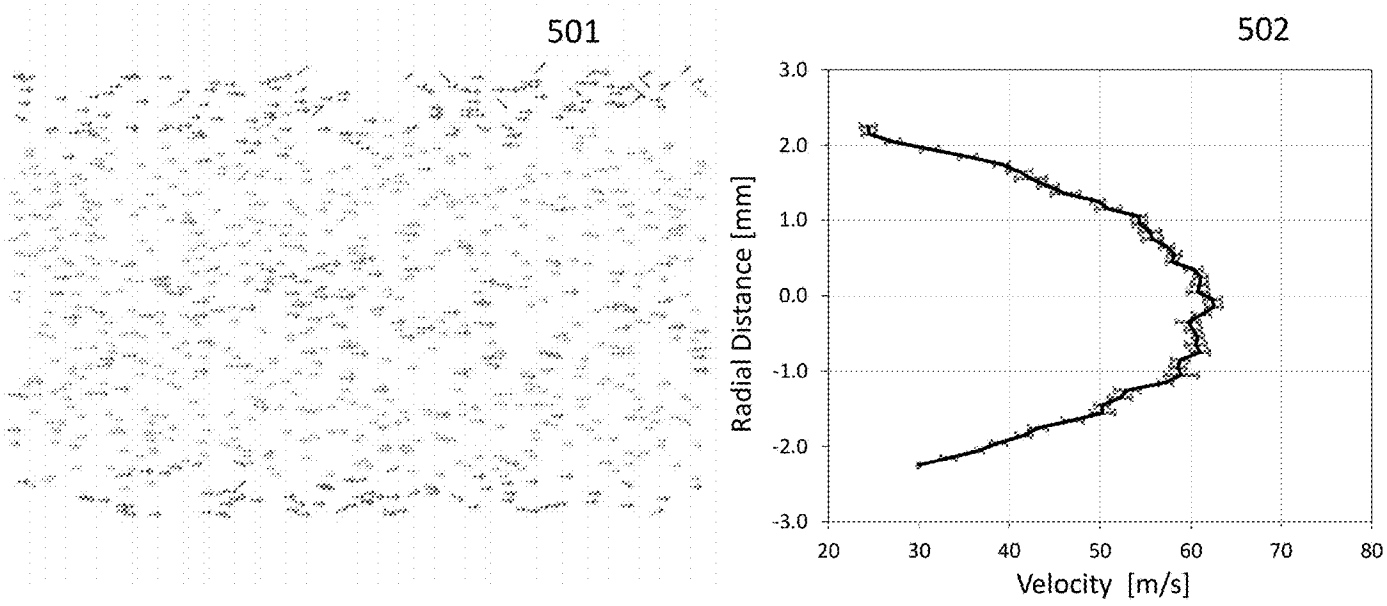

As a next illustration, the velocity vector field 401 and the velocity radial profile 402, taken at a distance of 40 mm from the entrance of the duct, demonstrate the unsteady-laminar character of the flow at a significantly reduced speed (FIG. 4). Here, the flow is shown confined by the physical boundary of the duct and local variations of the velocity are contained to within ±30 m/s.

For a sonic under-expanded free jet stream with the same value of JPR~4 the onset of the transitional flow occurs at approximately the same distance of 40 mm and the radial size of the free jet stream grow progressively beyond the physical boundary imposed by the duct. Finally, the steady-laminar character of the flow is clearly demonstrated at 80 mm from the entrance and toward the exit of the duct by showing stratified velocity vectors 501. The corresponding quasi-parabolic velocity radial profile 502 shows that variations in the magnitude of the velocity vectors are of the order of ±5 m/s (FIG. 5). The corresponding velocity profile at the same distance in the case of a sonic jet undergoing free adiabatic expansion at 50 mbar background pressure is characterized by a fully developed turbulent gas motion.

Experiments show that, by increasing the pressure to 100 mbar, the velocity profile at the exit of the duct is also laminar. The value of JPR in this case is 3 and the value for coefficient k is 8.3, within the range predicted to produce steady-laminar flows.

The length of the duct should most preferably be sufficiently long to allow for the laminar character of the flow to be fully developed. Typical lengths for ducts containing sonic jets at background pressures in the range of 1 mbar to 200 mbar in order for subsonic laminar flows to develop at the exit are at least 40 mm long. A supersonic laminar flow will be developed at the exit of the duct for the shorter lengths, which may undergo transition to develop a fully turbulent character further downstream.

Another parameter that may influence the lateral dimensions of the duct is the Reynolds number at the exit of the inlet aperture or capillary. The onset of turbulence occurs at shorter distances for the greater values of the Reynolds number, therefore the lateral size of the duct should most preferably be reduced to meet the boundaries of the free jet at the early stages of the expansion. Another parameter that influences the development of laminar flow is the temperature of the gas and the temperature of the duct.

Figure 6:
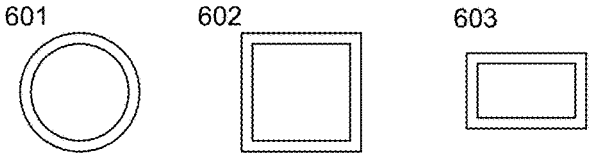
FIG. 6 shows cross sectional views of different ducts that can be employed for flow laminarization and the elimination of turbulent gas motion.

FIG. 6 shows cross sectional views of different ducts that can be employed for flow laminarization and the elimination of turbulent gas motion. A cylindrical- or square-shaped (601, 602) duct can be matched with the round shape of apertures typically employed to separate vacuum regions operated at different pressures. A rectangular-shaped duct 603 may be more suitable to produce cross-sectionally asymmetric gas flows, which can be matched to asymmetric ion optical systems such as those employed in planar differential mobility spectrometry. One skilled in the art should appreciate that other non-uniform cross sectional shapes and ovals are possible alternatives.

Figure 7:
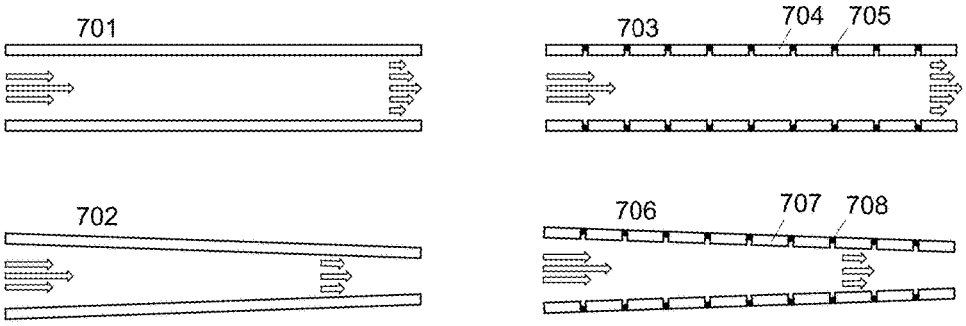
FIG. 7 shows examples of different duct geometries.

FIG. 7 shows examples of different duct geometries. A parallel conductive duct 701 and a converging-shaped duct 702 may be employed to generate a laminar flow where a field-free region is established throughout the length and where fringe fields at the entrance and exit of the device can be used for ion focusing. Alternatively, a uniform internal diameter duct 703 may be employed comprising a series of conductive rings 704 and insulating spacers 705.

Independent DC and/or RF potentials may be applied to each of the conductive rings to focus ions toward the axis of the device or provide radial compression of the ion beam. A converging geometry duct 706 is shown and includes a series of conductive rings 707 which is also capable of producing a laminar flow as herein proposed.

Further, insulating rings 708 may be used to form a closed duct or can be omitted as long as the physical boundary replacing the free shear layer of the flow in the transitional and turbulent regions of in the far-field region of the free jet are not significantly obstructed. Insulating rings 708 with openings may also be desirable to allow gas to escape radially and reduce the gas load to ion optical devices disposed further downstream. This is also an effective method to reduce the speed of the gas inside the duct further. A laminar flow at reduced speed sustained throughout a differential mobility spectrometer increases ion residence time and improves resolving power.

The segmented design may consist of stainless steel rings or a set of PCB electrodes with thicknesses of the order of a few mm Typical spacing can be of the order of 0.5 mm One skilled in the art would appreciate that various alternative configurations are possible. For example, it is possible to provide rings that are segmented along their respective perimeter to generate quadrupole or higher-order potential distributions, as along as the direction of the gas flow and the physical boundary imposed by the conductive rings is not significantly obstructed. An RF ion guide with an inscribed radius selected to satisfy the conditions imposed by Equation 1 may, for example, be provided.

In another aspect of the present invention, radial compression of the ions is provided by application of a progressively accelerating potential distribution along the axis of the device. For a progressively accelerating potential distribution along the axial dimension z, the second derivative of the potential along z axis (axis of the duct) is negative, $d^2V/dz^2<0$ and a weak force pushing ions toward the axis is generated.

Figure 8:
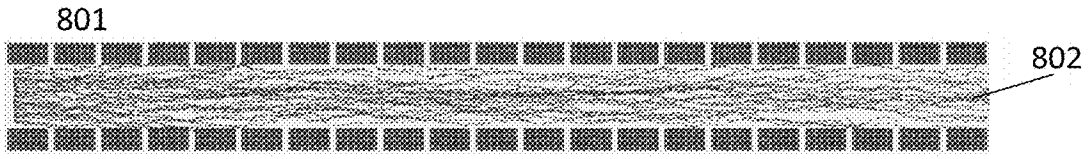
FIG. 8 shows ion trajectory across a duct operated at 5 mbar and comprised of 3 mm long ring-electrodes and 0.5 mm spacing with no potential being applied.

FIG. 8 shows ion trajectory across a duct 801 operated at 5 mbar and comprised of 3 mm long ring-electrodes and 0.5 mm spacing with no potential being applied (51). From the trajectories 802 it is established that diffusion drives a significant portion of the ions against the electrodes.

Figure 9:
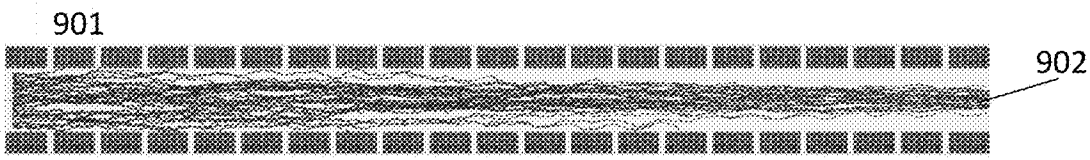
FIG. 9 shows, for the same dimensioned duct as in FIG. 8, ion focusing by application of a progressively accelerating DC potential generated along the axis of the device.
Figure 10:
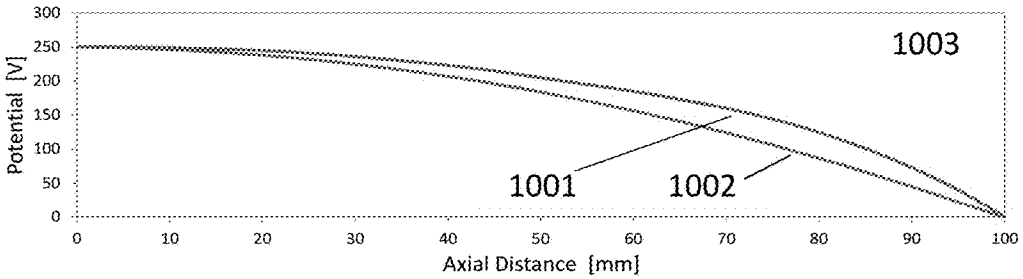
FIG. 10 is a graph showing axial potential distributions used in a simulation.

FIG. 9 shows the same duct 901 wherein ion focusing (902) is possible by application of a progressively accelerating DC potential generated along the axis of the device. Typical axial potential distributions used in the simulation 1001, 1002 are shown in the graph 1003 shown in FIG. 10.

From the graph, it is established that: the greater the second derivative, the greater the focusing strength the ions experience. Specifically, graph 1003 establishes that potential distribution 1001 exhibits a significant stronger focusing field than that of potential distribution 1002.

Focusing strength is also partially determined by the overall potential drop across the length of the device. In this example, the voltage drop from entrance to exit is limited to 250 V. Greater potential differences can be employed, which may appear particularly useful when operating the device at pressures well above 1 mbar.

The focusing mechanism is also present when decelerating potential distributions are established and the second derivative of the potential in the axial direction remains negative. This alternative solution can be applied in regions where the speed of the gas is sufficiently strong compared to the opposing electrical forces pushing ions forward. Thus, the overall potential drop required to transport ions from the entrance to the exit of the duct can be minimized. The focusing mechanism in the presence of DC potential gradients where the second derivative of the electrical potential along the axis with respect to axial distance is negative—namely, $d^2V/dz^2<0$—is effective at pressures significantly greater than those where existing ion optical technology can be employed, for example the ion funnel where ion transmission at 30 mbar and beyond drops off considerably.

A decelerating DC potential distribution formed across the duct may also provide a way to extend ion residence time inside the duct thus promoting desolvation of charged droplets and cluster ions via collisions with buffer gas molecules. Desolvation can be further enhanced by operating the duct at elevated temperatures. Admission of charged droplets into the vacuum region is expected to help overcome the space charge limit of inlet capillaries and improve transmission efficiency and overall instrument sensitivity. A duct disposed in the fore vacuum region of a mass spectrometer is capable of confining large charged droplets with high inertia and eliminating losses associated with extended radial expansion in the near-field region of the free jet.

In another aspect of the present invention the decelerating potential formed across the duct may be used to selectively transmit ions within a specific ion mobility range. High mobility species can be reflected backwards by the opposing electrical forces while lower mobility ions can be gradually transmitted through the duct by varying the DC gradient. Preferably, the ion mobility selection is performed toward the end of the duct in the region where laminar flow conditions are established.

In yet another aspect of the present invention, RF voltages can be applied to the ring electrodes to induce focusing. Two different voltage waveforms with 180 degrees phase shift are applied to even and odd numbered ring electrodes respectively.

Figure 11:
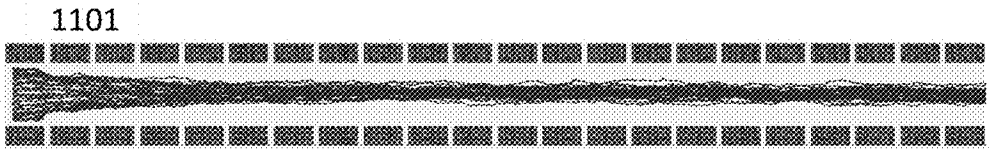
FIG. 11 shows, for similar geometries as those used to take the measurements described in FIGS. 8 and 9, results of applying two voltage waveforms at a frequency of 2 MHz and 150 $V_{0-p}$ amplitude.

FIG. 11 shows the same geometry 1101 examined in FIGS. 8 and 9 where two voltage waveforms are applied at a frequency of 2 MHz and 150 $V_{0-p}$ amplitude. Focusing at 5 mbar is a result of the fringe fields established between neighboring electrodes supplied with waveforms having 180 degree phase shift. The focusing mechanism is lost when the thickness of the ring electrodes is reduced to those typically employed in an ion funnel (i.e., 0.6 mm) Thicknesses of the order of 2 to 3 mm are found to be the optimum range for the fringe fields to exhibit a sufficiently strong focusing effect. Waveforms with different phase shifts other than the 180° described above can also be designed to induce radial compression of the ions within the duct.

In yet another aspect of the present invention, focusing is enhanced by superposition of the DC and RF potentials discussed above. It may be desirable for the maximum gradient of the accelerating DC potential to be applied across the region where the free shear layer of the jet arrives at the physical boundary imposed by the geometry of the duct. In other preferred configurations, the ion optics at the exit of the duct used for transporting ions through narrow apertures and into consecutive vacuum regions operated at reduced pressures can be part of the progressively accelerating DC potential distributions. It may also be desirable for the RF waveforms not to be applied toward to exit of the duct to avoid defocusing as a result of the fringe fields near end apertures.

FIG. 12, previously introduced, is a high level instrument architecture and a gas flow diagram of a mass spectrometer configured in accordance with an exemplary embodiment herein.

The mass spectrometer includes an electrospray ionization source 1201 for producing ions, a capillary inlet 1202 to transport a gas flow entrained with ions into fore vacuum compartment 1203. Other methods for generating ions at atmospheric pressure can be employed readily apparent to those skilled in the art of mass spectrometry. A next stage vacuum compartment 1204 is evacuated by way of pumping port 1206. The two vacuum compartments 1203 and 1204 are isolated by a wall 1205 and allowed to communicate only through a duct 1207.

The under-expanded jet 1208 discharges into the duct 1207 where the turbulent character of the flow is suppressed. Various configurations of the duct can be employed as has already been discussed in greater detail above.

The supersonic gas at the entrance of the duct 1209 transforms progressively through an unsteady-laminar 1210 into a subsonic steady-laminar flow 1211 toward the exit. The vacuum chamber (or background) pressure in vacuum compartments 1203 and 1204 ranges from the lowest pressures attainable in the fore vacuum of a mass spectrometer, which is typically around 1 mbar, up to 100 mbar or higher, for example 400 mbar or even greater. The pressure differential across the duct is small or could be of equal pressure as between vacuum compartments 1203 and 1204.

Substantially equal pressures across the duct can be achieved through openings by entirely removing the wall 1205 separating the two vacuum compartments. Alternatively, pumping can also be applied to the first vacuum sub-compartment 1203.

Ions can be focused further through one or more narrow apertures. In the presently illustrated embodiment, a two-skimmer cone configuration is used 1212, 1213, into a subsequent vacuum region 1214 operated at a reduced pressure.

A turbomolecular pump can be employed to evacuate the second vacuum region 1215 and an RF ion guide 1216, for example an octapole or hexapole configuration can be used to transport ions through a narrow aperture further downstream 1217 and toward a collision cell, or a first mass analyser followed by a collision cell and that followed by a second mass analyser, or other possible ion optical configurations known to those of skill in the art.

Figure 13:
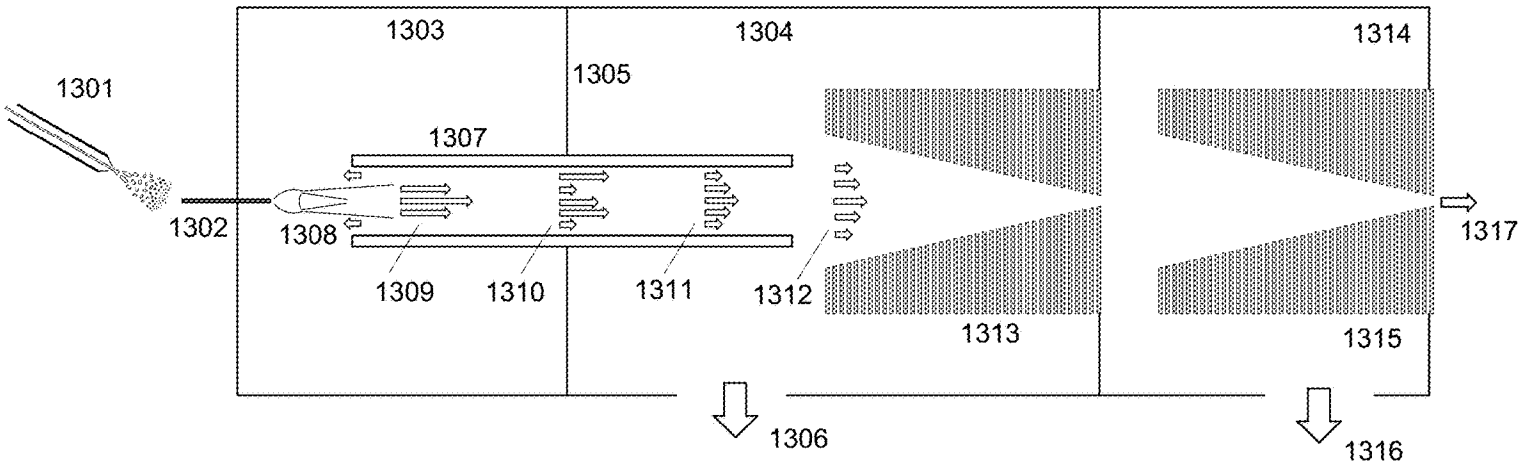

FIG. 13 is a high level instrument architecture and a gas flow diagram of a mass spectrometer configured in accordance with a further exemplary embodiment herein.

Referring to FIG. 13, a coaxial duct 1307 is shown coupled to an ion funnel 1313. In this configuration, the laminar flow 1312 reduces ion losses related to fully developed turbulent flows established near the limiting aperture when the under-expanded jet is allowed to expand freely inside the ion funnel.

In greater detail, ions are generated at atmospheric pressure by way of, for example, electrospray ionization 1301. A capillary inlet 1302 or other type of inlet apertures such as skimmer cones or combinations thereof can be employed to transport ions into the fore vacuum compartment 1303.

An ion funnel 1313 or other type of RF ion focusing devices are disposed into a second vacuum sub-compartment 1304, in direct communication with the fore vacuum sub-compartment 1303 through a coaxial duct 1307 described in greater detail in preceding figures. Vacuum compartments 0313 and 1304 are isolated 1305 and pumping 1306 is applied only through vacuum compartment 1304. Preferably, vacuum compartments 1303, 1304 are operated at substantially the same pressure and the isolation 1305 may be removed.

The under-expanded jet 1308 discharges into the coaxial duct 1307 which may be comprised of a series of ring-electrodes to which are applied a progressively accelerating field and/or a RF electrical field for focusing ions on axis. Other possible combinations of RF and DC fields described in greater detail may be desirable. The supersonic gas 1309 is decelerated and the unsteady-laminar or weakly transitional flow 1310 is progressively converted into a subsonic laminar flow 1311 at the exit of the duct 1307.

A low speed uniform flow 1312 is therefore presented at the entrance of the funnel 1313 and ion losses associated to fully developed turbulent motion in the converging end and near the limiting aperture of the funnel are greatly reduced. Ions can then be transported into a second vacuum region 1314, operated at lower pressure by way of either mechanical or turbomolecular pumping 1316, and further focused by a second ion funnel 1315 toward a mass analyser, a collision cell, an ion mobility spectrometer or other types of ion optical devices such as ion traps or reaction cells 1317.

Figure 14:
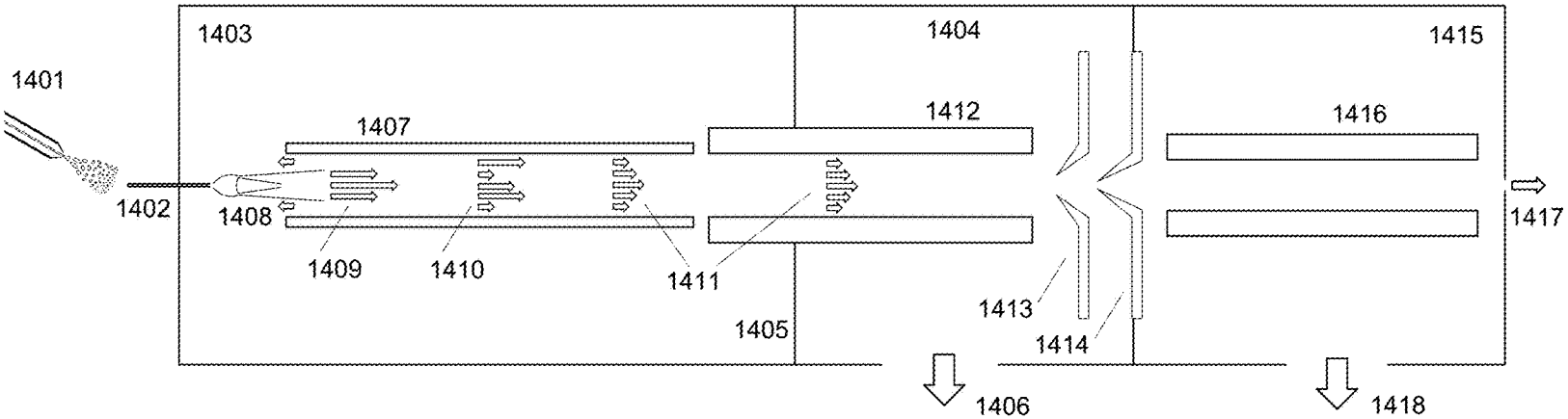

FIG. 14 is a high level instrument architecture and a gas flow diagram of a mass spectrometer of the type including a second compartment (hereafter a differential mobility spectrometer (or DMS compartment) 1404 disposed in the same fore vacuum region as the first compartment. DMS 1404 is configured to perform a differential mobility function in accordance with a further exemplary embodiment.

As shown, coaxial duct 1412 is communicably coupled to coaxial duct 1407 in the first compartment and it functions to maintain the laminar gas flow pattern formed in and received from first duck 1407, while simultaneously also functioning to facilitate separation based on differential mobility properties of ions.

The steady-laminar flow generated by coaxial duct 1407 used to transport ions through second communicably coupled coaxial duct 1412 may be operated at a reduced pressure.

Differential mobility type spectrometer devices generally require steady- or at least unsteady laminar flows to preserve their resolving capabilities and filter ions depending on variations in ion mobility characteristics, for example, the dependence of ion mobility on electric field and gas density, or the ability to form clusters during low-field conditions and dissociate those into bare ions under high-field conditions by introducing chemical modifiers in the gas flow.

Referring to FIG. 14, ions are generated by electrospray ionization 1401 or other types of atmospheric pressure ionization methodologies such a chemical ionization, penning ionization, laser desorption ionization or combinations thereof. Chemical modifiers for the generation of cluster ions inside DMS compartment 1404 can be mixed with the liquid sample to be sprayed or introduced in the form of vapors through the nebulizing gas or curtain gas typically used in electrospray ionization to promote droplet dispersion and desolvation. Transportation of ions and gas through a narrow capillary 1402 forms a supersonic under-expanded jet 1408, which discharges into the coaxial duct 1407 disposed within first vacuum compartment 1403.

The supersonic gas flow 1409 undergoes transitions 1410 to form a steady laminar flow 1411 directed toward coaxial duct 1412 in DMS compartment 1404. The steady- or unsteady-laminar flow conditions are preserved throughout the respective length 1411 of coaxial duct 1412. Coaxial duct 1412 is partially enclosed by a wall surface 1414 of neighboring compartment 1415.

A pumping port (1416) is used to control pressure in compartment 1414, and—since the latter is communicably coupled to 1413—also to evacuate pressure from compartment 1413. One skilled in the art should appreciate that there are many arrangements and configurations for pumping compartments that may be suitable for this purpose.

Vacuum compartments 1403 and 1404 may be operated at substantially the same pressure to cooperatively create a substantially uniform pressure region.

Duct 1412 may be comprised of two co-planar electrodes to which an appropriate asymmetric waveform and a compensation voltage ramp are applied to manipulate ion motion. In this case, duct 1412 may be formed as a rectangular coaxial duct to match the lateral dimensions of a DMS channel and to provide the necessary laminar gas flow conditions associated with such a geometry. However, other types of suitable geometries are equally contemplated herein and intended to be within the scope of the claimed embodiments. One such configuration includes but is in no way limited to duct 1412 also operating as a multipole ion guide. Such guides are known and include configurations with, for example, twelve poles to which appropriate potentials are applied to form an alternating RF asymmetric dipole field and an additional compensating field to control lateral ion motion.

Coaxial duct 1412 is preferably cylindrical with dimensions appropriate to match those of the cylindrical channel of duct 1407, in the example of FIG. 14. Ions filtered by duct 1412 are further focused through skimmer apertures 1413 and 1414. Other types of ion focusing mechanisms may be used to replace the skimmer lens, for example an ion funnel, or other RF ion focusing devices.

In an alternative embodiment, a further coaxial duct may be used to capture ions filtered through duct 1412 and refocus them on axis under laminar flow conditions and toward a limiting aperture into the second vacuum region 1415, evacuated by a turbomolecular pump 1418 where a RF ion guide 1416 can be used to transport ions further downstream 1417.

In yet another preferred embodiment, duct 1412 may replaced by a second duct forming a system of two consecutive ducts 1407, 1412 preferably having the same cross sectional area and separated by a small distance, for example 1 or 2 mm. The first duct may be entirely immersed in the first vacuum compartment 1403 and the second duct disposed between compartments 1403 and 1404. Preferably, the second duct 1412 is designed with a cross section area smaller compared to the first duct 1407 to accept the ions while allowing gas to escape through the gap in-between and to reduce the gas load to pressure limiting aperture or any other RF and DC ion optical element disposed further downstream.

As explained above, the presently disclosed guide apparatus may be a mass spectrometer, a differential mobility spectrometer, or a mass spectrometer of the type including a compartment in a fore vacuum region which is configured to facilitate separation based on differential mobility properties of ions.

A variety of duct configurations are described and contemplated. It should be appreciated that in addition to the single duct and two-duct configurations disclosed herein, are a variety of configurations are possible including configurations with more than two ducts communicable coupled to form or maintain laminarization.

A duct may be configured to form a laminar gas flow pattern only, to maintain a laminar gas flow pattern only, to maintain or form a laminar gas flow pattern and also confine ions as is typical of an ion guide or other types of ion focusing devices. A duct may further alternatively be configured to maintain or form a laminar gas flow pattern and simultaneously facilitate separation based on differential mobility properties of ions.

In view of this disclosure it is noted that the methods and apparatuses can be implemented in keeping with the present teachings. Further, the various components, materials, structures and parameters are included by way of illustration and example only and not in any limiting sense. In view of this disclosure, the present teachings can be implemented in other applications and components, materials, structures and equipment to needed implement these applications can be determined, while remaining within the scope of the appended claims.

Those of skill in the art would understand that information and signals may be represented using any of a variety of different technologies and techniques. For example, data, instructions, commands, information, signals, bits, symbols, and chips that may be referenced throughout the above description may be represented by DC voltages, currents, RF voltage waveforms and corresponding electric fields, or any combination thereof.

What is claimed is:

1. A guide apparatus comprising: a vacuum compartment provided at a background pressure and having a gas inlet opening arranged for jetting a gas in the form of a free jet stream containing entrained ions into a vacuum chamber along a predetermined jetting axis; and at least one duct housed within the vacuum chamber and having a guide bore positioned coaxially with the jetting axis for receiving the free jet stream such that a supersonic free jet is formed in the duct with a jet pressure ratio $P_1/P_2$ restrained to a value that does not exceed $(A/a)^3$ to form a subsonic laminar gas flow inside of the duct for guiding the entrained ions therealong, where $P_1$ is the pressure at an exit end of the gas inlet opening, $P_2$ is the background pressure, A is the cross sectional area of the bore, and a is the cross sectional area of the gas inlet opening.

2. The guide apparatus according to claim 1, wherein the jet pressure ratio $P_1/P_2$ is restrained to a value lower than $(A/a)^3$ by a factor within the range of $1.4\times10^{-3}$ to $2\times10^{-7}$.

3. The guide apparatus according to claim 1, wherein the jet pressure ratio $P_1/P_2$ is restrained to a value lower than $(A/a)^3$ by a factor within the range of $6.4\times10^{-5}$ to $5.6\times10^{-7}$.

4. The guide apparatus according to claim 1, wherein the jet pressure ratio $P_1/P_2$ is restrained to a value lower than $(A/a)^3$ by a factor within the range of $4.6\times10^{-6}$ to $3.2\times10^{-6}$.

5. The guide apparatus according to claim 1, further comprising an ionization source for providing the free jet stream containing entrained ions.

6. The guide apparatus according to claim 1, wherein the vacuum compartment includes a pumping port for setting the pressure in the vacuum compartment to a desired pressure level.

7. The guide apparatus according to claim 1, wherein a minimum length of the duct is 50 mm.

8. The guide apparatus according to claim 1, wherein the duct is comprised of a series of conductive ring electrodes.

9. The guide apparatus according to claim 8, further comprising a field generator configured to apply a DC electrical potential with a negative second derivative across the conductive ring electrodes along the jetting axis to generate an electrical field within the duct, the field generator being and arranged to focus entrained ions in the free jet stream radially within the duct.

10. The guide apparatus according to claim 9, wherein the series of conductive ring electrodes comprises a first set of ring electrodes and a second set of ring electrodes; and wherein the field generator is configured to generate a periodic electrical field by application of a first RF signal to the first set of ring electrodes and a second phase-shifted RF signal to the second set of ring electrodes to focus entrained ions upon the axis of the bore.

11. The guide apparatus according to claim 1, further comprising at least one of an ion funnel, a q-array and an RF focusing device disposed at an output end of the duct for focusing ions through pressure limiting apertures under laminar flow conditions.

12. The guide apparatus according to claim 1, wherein the guide apparatus is one of a mass spectrometer, a differential mobility spectrometer, and a mass spectrometer including a compartment in a fore vacuum region of the vacuum compartment configured to perform separation based on differential mobility properties of ions.

13. The guide apparatus according to claim 1, wherein the at least one duct comprises a first duct, and further comprising at least a second duct in series with the first duct.

14. The guide apparatus according to claim 13, wherein the guide apparatus is a mass spectrometer of the type including a compartment in a fore vacuum region which is configured to perform a differential mobility function, and wherein the second duct is a duct configured to maintain the laminar gas flow pattern formed in and received from the first duct, while simultaneously also functioning to facilitate separation based on differential mobility properties of ions.

15. A method of generating a flow of ions comprising:

providing ions within a gas at a first pressure;

providing a vacuum chamber with a second pressure therein lower than the first pressure, the vacuum chamber including a gas inlet opening having a first cross sectional area (a);

jetting the gas containing entrained ions into the vacuum chamber via the gas inlet opening along a predetermined jetting axis;

receiving the gas jet within a gas duct housed within the vacuum chamber, the duct including a bore having a second cross sectional area (A) and positioned in register with the gas inlet opening coaxially with the jetting axis; and selecting the second pressure for jetting the gas so as to form a supersonic free jet in the gas duct with a jet pressure ratio $P_1/P_2$ restrained to a value which does not exceed $(A/a)^3$ to thereby form a subsonic laminar gas flow inside of the duct for guiding the entrained ions therealong, where $P_1$ is the pressure at an exit end of the gas inlet opening, $P_2$ is the second pressure, a is the first cross sectional area, and A is the second cross sectional area.

16. The method according to claim 15, wherein the jet pressure ratio $P_1/P_2$ is restrained to a value lower than $(A/a)^3$ by a factor within the range of $1.4\times10^{-3}$ to $2\times10^{-7}$.

17. The method according to claim 15, wherein the jet pressure ratio $P_1/P_2$ is restrained to a value lower than $(A/a)^3$ by a factor within the range of $6.4\times10^{-5}$ to $5.6\times10^{-7}$.

18. The method according to claim 15, wherein the jet pressure ratio $P_1/P_2$ is restrained to a value lower than $(A/a)^3$ by a factor within the range of $4.6\times10^{-6}$ to $3.2\times10^{-6}$.

19. A guide apparatus for generating a flow of ions, the guide apparatus comprising:

an ionization source configured to provide ions within a gas at a source pressure;

a vacuum chamber in communication with the ionization source and configured to achieve a second pressure therein lower than the source pressure, the vacuum chamber including a gas inlet opening having a first cross sectional area and arranged for jetting the gas containing entrained ions from the ionization source into the vacuum chamber along a predetermined jetting axis; and a gas duct housed within the vacuum chamber and including a bore having a second cross sectional area and positioned in register with the gas inlet opening coaxially with the jetting axis for receiving the jet of gas such that a supersonic free jet is formed in the duct with a jet pressure ratio $P_1/P_2$ restrained to a value that does not exceed $(A/a)^3$ to thereby form a subsonic laminar gas flow inside of the duct for guiding the entrained ions therealong, where $P_1$ is the pressure at an exit end of the gas inlet opening, $P_2$ is the second pressure, a is the first cross sectional area, and A is the second sectional area.

20. The guide apparatus according to claim 19, wherein the jet pressure ratio $P_1/P_2$ is restrained to a value lower than $(A/a)^3$ by a factor within the range of $1.4\times10^{-3}$ to $2\times10^{-7}$.

21. The guide apparatus according 8, further comprising a field generator configured to apply a DC electrical potential across the conductive ring electrodes to generate a decelerating DC potential distribution that extends a residence time of the entrained ions inside of the duct to promote desolvation of charged droplets and cluster ions within the duct.

* * * * *